US011195641B2

(12) United States Patent
Dong et al.

(10) Patent No.: US 11,195,641 B2
(45) Date of Patent: Dec. 7, 2021

(54) ELECTRIC-SUBMERSIBLE-PUMP COMPOSITE DUCT CABLE AND MANUFACTURING METHOD THEREOF

(71) Applicant: SHINDA (TANGSHAN) CREATIVE OIL & GAS EQUIPMENT CO., LTD., Tangshan (CN)

(72) Inventors: Jian Dong, Tangshan (CN); Jianliang Duan, Tangshan (CN)

(73) Assignee: SHINDA (TANGSHAN) CREATIVE OIL & GAS EQUIPMENT CO., LTD., Tangshan (CN)

( * ) Notice: Subject to any disclaimer, the term of this patent is extended or adjusted under 35 U.S.C. 154(b) by 0 days.

(21) Appl. No.: 17/034,531

(22) Filed: Sep. 28, 2020

(65) Prior Publication Data

US 2021/0350951 A1 Nov. 11, 2021

(30) Foreign Application Priority Data

May 11, 2020 (CN) ..... 202010393384.3

(51) Int. Cl.

| | |
|---|---|
| ***H01B 7/02*** | (2006.01) |
| ***H01B 7/282*** | (2006.01) |
| ***H01B 7/04*** | (2006.01) |
| ***H01B 3/44*** | (2006.01) |
| *H01B 7/14* | (2006.01) |

(52) U.S. Cl.

CPC ..... *H01B 7/2825* (2013.01); *H01B 3/44* (2013.01); *H01B 7/045* (2013.01); *H01B 7/14* (2013.01)

(58) Field of Classification Search

CPC ... H01B 3/44; H01B 7/02; H01B 7/04; H01B 7/17; H01B 7/18; H01B 7/20; H01B 7/28; H01B 7/2875; H01B 7/045; H01B 7/14; H01B 13/00

USPC ..... 174/102 R, 110 R, 113 R, 115, 116

See application file for complete search history.

(56) References Cited

U.S. PATENT DOCUMENTS

H631 H * 5/1989 Hamad et al. ..... B23P 19/04 29/645

FOREIGN PATENT DOCUMENTS

CN 109036646 A * 12/2018 ..... H01B 7/17

* cited by examiner

*Primary Examiner* — William H. Mayo, III

(74) *Attorney, Agent, or Firm* — Marshall, Gerstein & Borun LLP

(57) ABSTRACT

An electric-submersible-pump composite duct cable is provided and includes a steel tube shell and an isolation layer. The isolation layer covers the outer circumferential surface of an ethylene-propylene jacket. The steel tube shell covers the outer circumferential surface of the isolation layer. Multiple signal cable assemblies and multiple injection agent tubes are arranged inside the isolation layer. Each signal cable assembly and each injection agent tube are in staggered arrangement at the internal center of the ethylene-propylene jacket. A manufacturing method of the electric-submersible-pump composite duct cable mainly includes two steps of manufacturing the isolation layer and machining the steel tube shell.

5 Claims, 3 Drawing Sheets

ELECTRIC-SUBMERSIBLE-PUMP COMPOSITE DUCT CABLE AND MANUFACTURING METHOD THEREOF

TECHNICAL FIELD

The present invention relates to the technical field of submersible oil pump cables, and in particular to an electric-submersible-pump composite duct cable and a manufacturing method thereof.

BACKGROUND

The submersible oil pump cable is a special cable matching with the submersible oil pump unit and is generally applied to the oil well. The lower end of the cable is connected with a submersible oil pump, and the upper end is connected with a ground unit control cabinet. In addition, chemical injection agents may be added to the oil well through the cable in the oil well operation process. However, the existing submersible oil pump cable generally has a flat structure, and the operating condition in the oil well is harsh; so, the cable is usually located in a high-temperature, high-pressure and high-corrosion environment. Furthermore, the electric submersible pump only can match with the coiled tubing in use. Due to load bearing, the cable cannot be too long. The cable is externally armored so as to have poor resistance to the externally immersed liquid, and the armored layer is easy to remove.

SUMMARY

The objective of the present invention is to provide an electric-submersible-pump composite duct cable, solving the problems that the submersible oil pump cable is externally armored in the prior art so as to have poor resistance to the externally immersed liquid, and the armored layer is easy to remove.

To solve the above-mentioned technical problem, the present invention adopts the following technical solution:

An electric-submersible-pump composite duct cable of the present invention comprises a steel tube shell and an isolation layer. The isolation layer covers the outer circumferential surface of an ethylene-propylene jacket. The steel tube shell covers the outer circumferential surface of the isolation layer. Multiple signal cable assemblies and multiple injection agent tubes are arranged inside the isolation layer. Each signal cable assembly and each injection agent tube are in staggered arrangement at the internal center of the ethylene-propylene jacket.

Further, there are specifically three staggered signal cable assemblies and injection agent tubes, respectively. Each signal cable assembly comprises an innermost conductor. A sintered film is arranged outside the conductor. An ethylene-propylene insulation layer is arranged outside the sintered film. A polytetrafluoroethylene (F4) film is arranged outside the ethylene-propylene insulation layer. A nylon fabric layer is arranged outside the polytetrafluoroethylene (F4) film. The injection agent tubes comprise the first injection agent tube and two second injection agent tubes. The diameter of the first injection agent tube is larger than the diameter of the second injection agent tube.

Further, the isolation layer specifically is a nylon tape layer, a steel plate or a protective steel tube.

A manufacturing method of an electric-submersible-pump composite duct cable is used for manufacturing the above electric-submersible-pump composite duct cable and specifically comprises the following steps:

step 1, manufacturing the isolation layer: because the outermost layer of an electric-submersible-pump cable in initial state is the ethylene-propylene jacket, and multiple signal cable assemblies and multiple injection agent tubes are arranged inside a steel strip armored layer, arranging the isolation layer on the outer circumferential surface of the ethylene-propylene jacket through a relative machining device;

step 2, machining the steel tube shell: placing a steel coil raw material for producing the steel tube shell on the first steel strip placement stand; placing a spare cable coated with the isolation layer in step 1 on a payoff stand; guiding the start end of the steel coil raw material to sequentially pass through a steel tube initial forming device, the payoff stand, a laser welding device, a nondestructive testing device, a drawing device and a tractor to produce a steel tube shell covering the spare cable; finally, winding a finished-product electric-submersible-pump composite duct cable composited with the steel tube shell by the second take-off stand for later use.

Further, in step 1, when the isolation layer is a nylon tape layer, the reel of the electric-submersible-pump cable in initial state is placed on the payoff stand; the start end of the electric-submersible-pump cable in initial state passes through a wrapping machine to form a spare cable coated with the nylon tape layer; the spare cable is wound by the first take-off stand for later use.

Further, in step 1, when the isolation layer is a protective steel tube, the reel of the electric-submersible-pump cable in initial state is placed on the payoff stand; the start end of the electric-submersible-pump cable in initial state sequentially passes through an armoring machine and a tractor to form a spare cable coated with the protective steel tube; the spare cable is wound by the first take-off stand for later use.

Further, a cavity structure is formed between the isolation layer formed by the protective steel tube and the ethylene-propylene jacket.

Further, when the isolation layer is formed by the protective steel tube, the reel of the electric-submersible-pump cable in initial state is placed on the payoff stand; a steel coil raw material for producing the isolation layer is placed on the first steel strip placement stand; the start end of the steel coil raw material sequentially passes through the steel tube initial forming device, the payoff stand, the laser welding device, the nondestructive testing device, the drawing device and the tractor to produce a steel-tube isolation layer covering the initial cable; finally, the spare cable composited with the steel-tube isolation layer is wound by the second take-off stand for later use. When the start end of the steel coil raw material passes through the laser welding device, the small-power laser is utilized to weld, the welding depth is controlled in the range of 80-100%, and the thickness of the protective steel tube is in the range of 0.2-0.5 mm.

Further, when the isolation layer is formed by the steel plate, the steel plate is bonded on the ethylene-propylene jacket and located below a laser welding portion of the steel tube shell. In a compositing process, a steel coil raw material for producing the steel tube shell is placed on the first steel strip placement stand; the reel of the electric-submersible-pump cable in initial state is placed on the payoff stand; the steel plate for producing the isolation layer is placed on the second steel strip placement stand; the start end of the steel coil raw material for producing the steel tube shell sequentially passes through the steel tube initial forming device, the payoff stand, the second steel strip placement stand, the laser welding device, the nondestructive testing device, the drawing device and the tractor to produce a steel tube shell covering the spare cable; finally, the finished-product electric-submersible-pump composite duct cable composited with the steel tube shell is wound by the second take-off stand for later use.

Compared with the prior art, the present invention has the following beneficial effects:

The whole electric-submersible-pump composite duct cable has a round structure and comprises the steel tube shell, the steel strip armored layer and the isolation layer; so, the cable has high strength. Three injection agent tubes are arranged in the cable, wherein the first injection agent tube with the large diameter in the cable can be used for adding injection agents such as a coolant, a cleaning agent, a preservative and the like, which is beneficial to ensuring the service performance and the service life of the cable. The second injection agent tubes with the small diameter can be used for adding the hydraulic oil to improve the utilization ratio of the inner space of the well, which is beneficial to ensuring the stable supply of the hydraulic oil and reducing the potential safety hazard. The steel tube shell is additively arranged; the steel tube shell can provide the tension required by the electric submersible pump and can effectively insulate the immersed liquid. Furthermore, there are various steel tube materials; so, the corrosion problem can be effectively solved. The manufacturing method of an electric-submersible-pump composite duct cable mainly comprises two steps of manufacturing the isolation layer and machining the steel tube shell. The outermost layer of the electric-submersible-pump cable in initial state is the steel strip armored layer. The arrangement of the isolation layer effectively ensures the safety in the steel tube shell machining process; especially at the welding station, the isolation layer can insulate the heat in the welding preheating process to avoid the burning problem in the welding process.

BRIEF DESCRIPTION OF THE DRAWINGS

The present invention is further described below with reference to the accompanying drawings.

Description of reference signs: 1—steel tube shell, 2—isolation layer, 3—ethylene-propylene jacket, 4—conductor, 5—sintered film, 6—ethylene-propylene insulation layer, 7—polytetrafluoroethylene (F4) film, 8—nylon fabric layer, 9—first injection agent tube, 10—second injection agent tube, 11—tension adjuster, 12—payoff stand, 13—wrapping machine, 14—first take-up stand, 15—armoring machine, 16—tractor, 17—first steel strip placement stand, 18—steel tube initial forming device, 19—laser welding device, 20—nondestructive testing device, 21—drawing device, 22—second take-up stand, 23—second steel strip placement stand, 24—first fixed pulley, 25—adjusting roller, 26—second fixed pulley, and 27—guide sheet.

DESCRIPTION OF THE EMBODIMENTS

Figure 1:
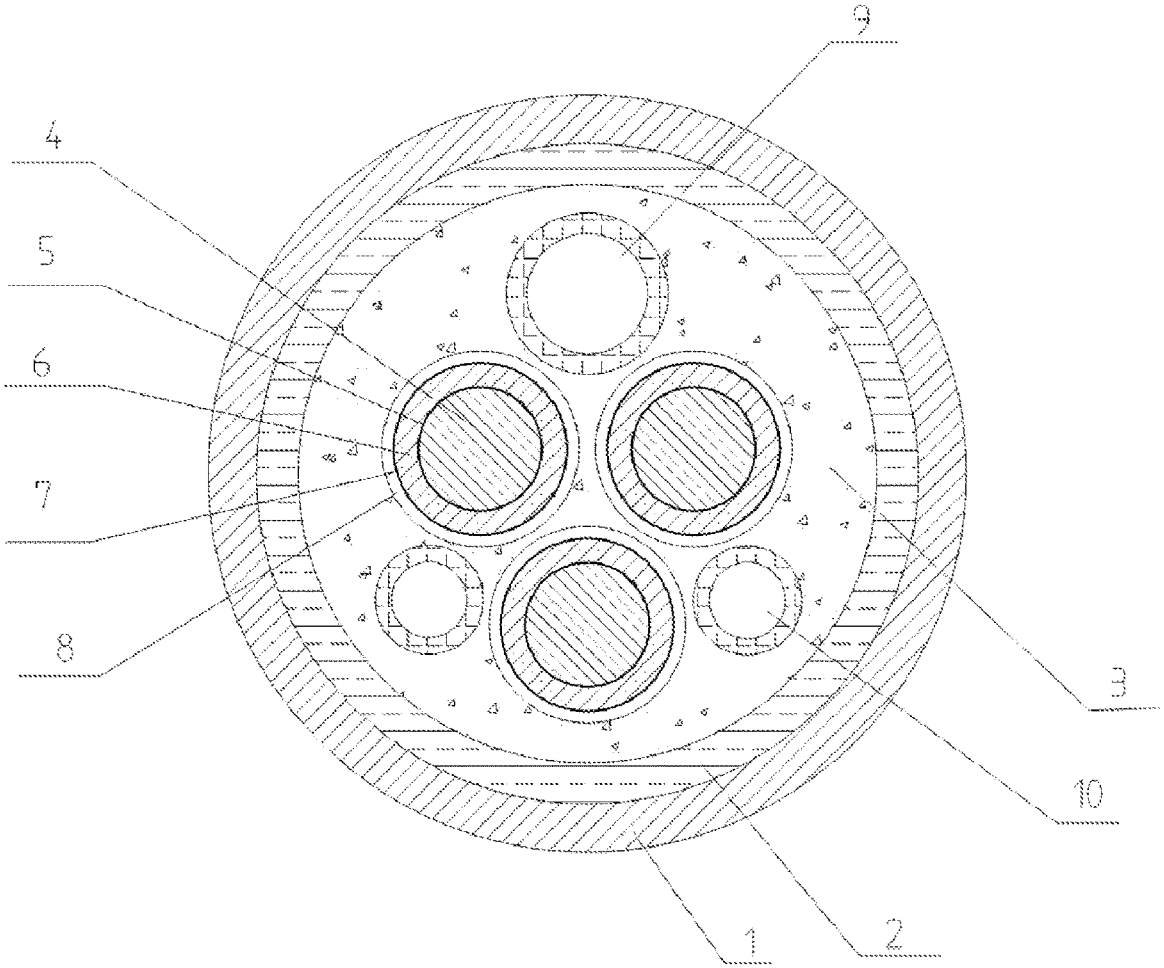
FIG. 1 is a sectional view of an electric-submersible-pump composite duct cable of the present invention.

As shown in FIG. 1, an electric-submersible-pump composite duct cable comprises a steel tube shell 1 and an isolation layer 2. The isolation layer 2 covers the outer circumferential surface of an ethylene-propylene jacket 3. The steel tube shell 1 covers the outer circumferential surface of the isolation layer 2. Multiple signal cable assemblies and multiple injection agent tubes are arranged inside the isolation layer 2. Each signal cable assembly and each injection agent tube are in staggered arrangement at the internal center of the ethylene-propylene jacket 3. Specifically, the steel tube shell 1 is made of 2205 stainless steel. The steel tube shell specifically is a 2205 stainless steel continuous long tube with the outer diameter of 44.5 mm and the wall thickness of 4 mm.

Specifically, there are three staggered signal cable assemblies and injection agent tubes, respectively. Each signal cable assembly comprises an innermost conductor 4. A sintered film 5 is arranged outside the conductor 4. An ethylene-propylene insulation layer 6 is arranged outside the sintered film 5. A polytetrafluoroethylene film 7 is arranged outside the ethylene-propylene insulation layer 6. A nylon fabric layer 8 is arranged outside the polytetrafluoroethylene (F4) film 7. The injection agent tubes comprise the first injection agent tube 9 and two second injection agent tubes 10. The diameter of the first injection agent tube 9 is larger than the diameter of the second injection agent tube 10. Specifically, the conductor 4 is a bare copper conduct. The sintered film is polyimide-fluorinated ethylene propylene (F46) film. The first injection agent tube and the second injection agent tubes are specifically made of 825 alloys. The first injection agent tube 9 is a capillary tube with the outer diameter of 9.525 mm and the wall thickness of 1.245 mm. It is used for adding injection agents such as a coolant, a cleaning agent, a preservative and the like. The second injection agent tube 10 is a capillary tube with the outer diameter of 6.35 mm and the wall thickness of 1.245 mm. It is used for adding the hydraulic oil to help the hydraulic control of the electric submersible pump.

Specifically, the isolation layer 2 is a nylon tape layer, a steel plate or a protective steel tube. The steel plate or the protective steel tube specifically can utilize 2205 stainless steel. The arrangement of the isolation layer further reinforces the strength of the composite duct cable and prolongs the service life. The thickness of the isolation layer 2 formed by the nylon tape layer is in the range of 0.15-0.20 mm, preferably 0.18 mm. The size and the thickness of the isolation layer formed by the steel plate are in the range of 1-2 mm. The thickness of the isolation layer formed by the protective steel tube is in the range of 1-2 mm.

As shown in FIG. 2 to FIG. 5, a manufacturing method of an electric-submersible-pump composite duct cable is used for manufacturing the above electric-submersible-pump composite duct cable and specifically comprises the following steps:

step 1, manufacturing the isolation layer 2: because the outermost layer of an electric-submersible-pump cable in initial state is the ethylene-propylene jacket 3, and multiple signal cable assemblies and multiple injection agent tubes are arranged inside a steel strip armored layer 2, arranging the isolation layer 2 on the outer circumferential surface of the ethylene-propylene jacket 3 through a relative machining device;

step 2, machining the steel tube shell 1: placing a steel coil raw material for producing the steel tube shell 1 on the first steel strip placement stand 17; placing a spare cable coated with the isolation layer 2 in step 1 on a payoff stand 12; guiding the start end of the steel coil raw material to sequentially pass through a steel tube initial forming device 18, the payoff stand 12, a laser welding device 19, a nondestructive testing device 20, a drawing device 21 and a tractor 16 to produce a steel tube shell 1 covering the spare cable; finally, winding a finished-product electric-submersible-pump composite duct cable composited with the steel tube shell 1 by the second take-off stand 22 for later use. Specifically, the payoff speed of the spare cable is 2 m/min; the payoff speed of the steel coil raw material is 2 m/min; the power of laser welding is 5000 w; the welding thickness is in the range of 3-5 mm, preferably 3.95 mm.

Figure 2:
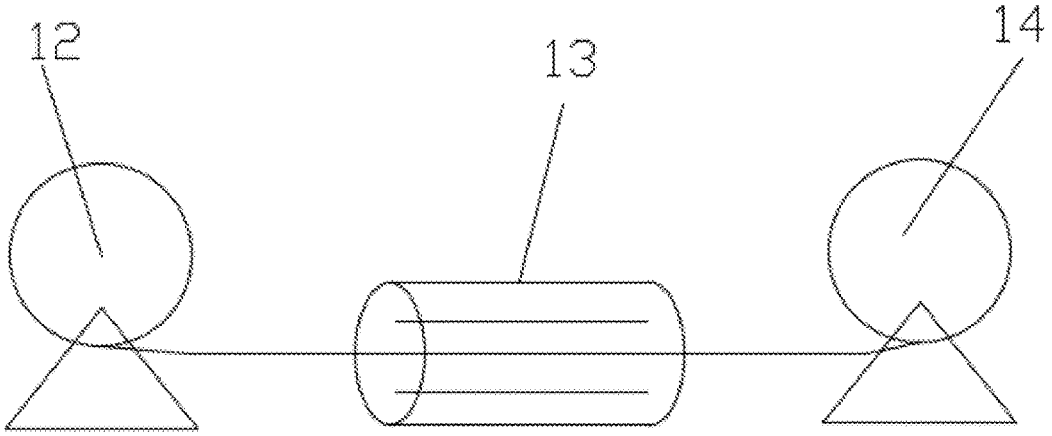
FIG. 2 is the first schematic diagram showing a manufacturing process of an isolation layer of the present invention.

As shown in FIG. 2, in step 1, when the isolation layer 2 is a nylon tape layer, the reel of the electric-submersible-pump cable in initial state is placed on the payoff stand 12; the start end of the electric-submersible-pump cable in initial state passes through a wrapping machine 13 to form a spare cable coated with the nylon tape layer; the spare cable is wound by the first take-off stand 14 for later use. Specifically, the payoff speed of the initial cable is 5 m/min; the thickness of the nylon tape layer is in the range of 0.15-2 mm, preferably 0.18 mm.

Figure 3:
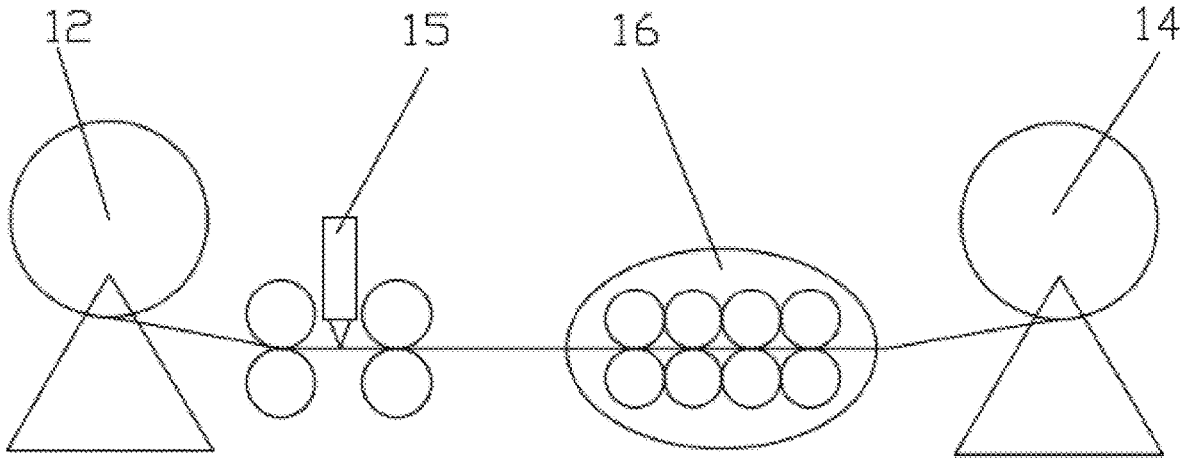
FIG. 3 is the second schematic diagram showing a manufacturing process of an isolation layer of the present invention.

As shown in FIG. 3, in step 1, when the isolation layer 2 is a protective steel tube, the reel of the electric-submersible-pump cable in initial state is placed on the payoff stand 12; the start end of the electric-submersible-pump cable in initial state sequentially passes through an armoring machine 15 and a tractor 16 to form a spare cable coated with the protective steel tube; the spare cable is wound by the first take-off stand 14 for later use. A cavity structure is formed between the isolation layer 2 formed by the protective steel tube and the ethylene-propylene jacket 3. Specifically, the gap value of the cavity structure is in the range of 0.3-0.5 mm to prevent welding burning. The payoff speed of the initial cable is 2 m/min; the thickness of the protective steel tube is in the range of 1.17-1.2 mm.

Figure 4:
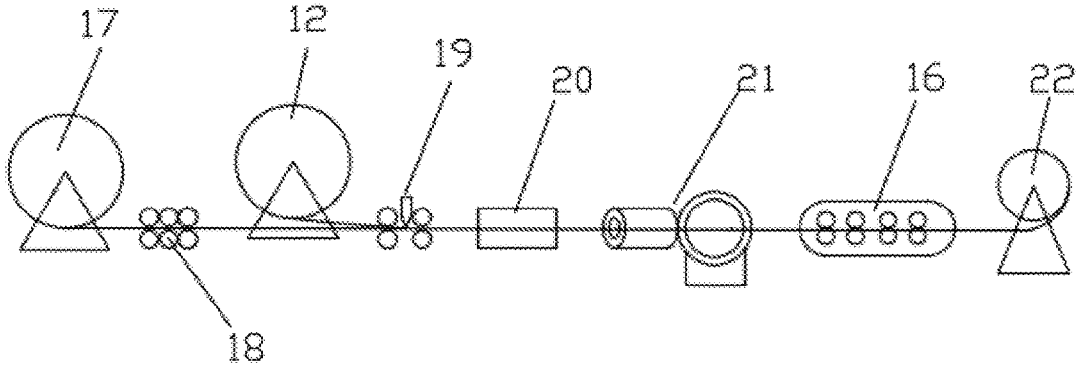
FIG. 4 is the first schematic diagram showing a manufacturing process of an electric-submersible-pump composite duct cable of the present invention.

As shown in FIG. 4, when the isolation layer 2 is formed by the protective steel tube, the reel of the electric-submersible-pump cable in initial state is placed on the payoff stand 12; a steel coil raw material for producing the isolation layer 2 is placed on the first steel strip placement stand 17; the start end of the steel coil raw material sequentially passes through the steel tube initial forming device 18, the payoff stand 12, the laser welding device 19, the nondestructive testing device 20, the drawing device 21 and the tractor 16 to produce a steel-tube isolation layer covering the initial cable; finally, the spare cable composited with the steel-tube isolation layer is wound by the second take-off stand 22 for later use. When the start end of the steel coil raw material passes through the laser welding device 19, the small-power laser is utilized to weld, the welding depth is controlled in the range of 80-100%, and the thickness of the protective steel tube is in the range of 0.2-0.5 mm. The power of the small-power laser welding is 1000 w. The payoff speed of the initial cable specifically is 1-1.5 μl/min. The thickness of the protective steel tube is in the range of 1.17-1.20 mm.

Figure 5:
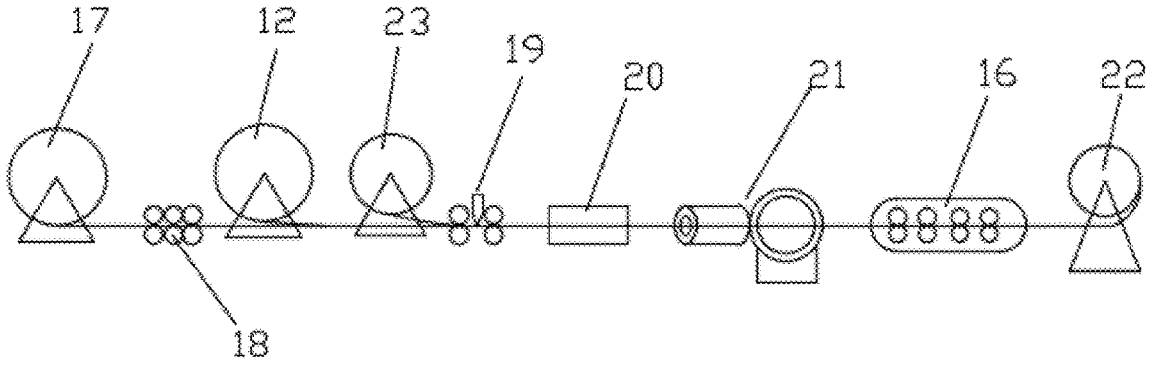
FIG. 5 is the second schematic diagram showing a manufacturing process of an electric-submersible-pump composite duct cable of the present invention.
Figure 7:
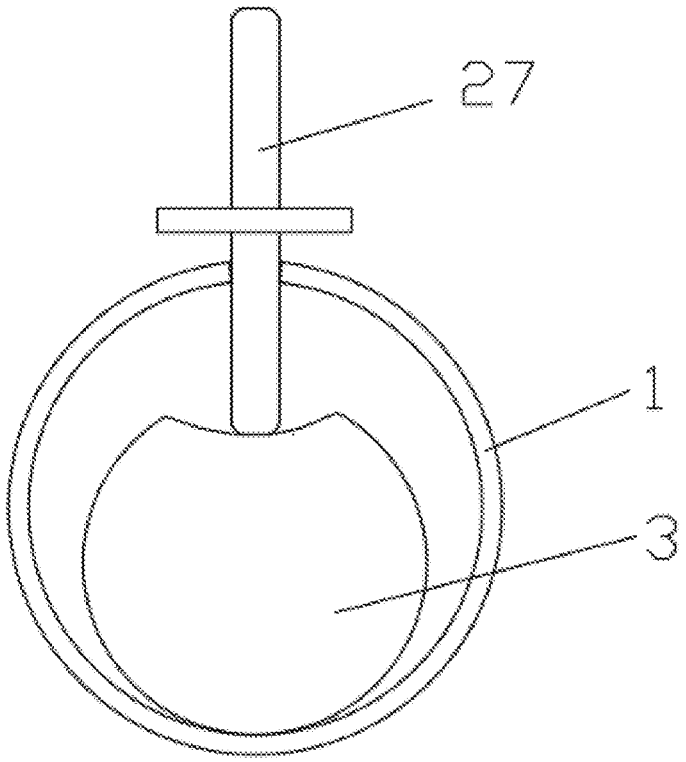
FIG. 7 is an axonometric view of the present invention when an isolation layer is a steel plate.

As shown in FIG. 5, when the isolation layer 2 is formed by the steel plate, the steel plate is bonded on the ethylene-propylene jacket 3 and located below a laser welding portion of the steel tube shell 1. In a compositing process, a steel coil raw material for producing the steel tube shell 1 is placed on the first steel strip placement stand 17; the reel of the electric-submersible-pump cable in initial state is placed on the payoff stand 12; the steel plate for producing the isolation layer 2 is placed on the second steel strip placement stand 23; the start end of the steel coil raw material for producing the steel tube shell 1 sequentially passes through the steel tube initial forming device 18, the payoff stand 12, the second steel strip placement stand 23, the laser welding device 19, the nondestructive testing device 20, the drawing device 21 and the tractor 16 to produce a steel tube shell 1 covering the spare cable; finally, the finished-product electric-submersible-pump composite duct cable composited with the steel tube shell 1 is wound by the second take-off stand 22 for later use. Specifically, as shown in FIG. 7, the payoff speed of the initial cable is 2 m/min. The steel plate has the width of 15 mm and the thickness in the range of 1.17-1.2 mm. The steel plate is pressed on the ethylene-propylene jacket 3 through a guide sheet 27 to form a channel and then is directly welded into the channel. The steel tube shell 1 is drawn to directly locate the steel plate in the channel of the ethylene-propylene jacket 3. Specifically, the guide sheet 27 is located at an operating position of the formed steel strip under the control of the steel tube initial forming device 18 to prevent the steel strip from deviating in the welding process. Furthermore, the guide sheet 27 has a new function of slotting the surface of the steel plate for insulation; so the excess weld metal in the laser welding process can be formed in the slot.

Furthermore, the isolation layer is also utilized as the steel strip armored layer. The steel strip armored layer is made of 316 L stainless steel and is S-shaped. Arc bulges are uniformly and densely distributed on the surface of the armored layer. The outer diameter of the armored layer is in the range of 35.70-36.50 mm. The machining method utilizes the production line shown in FIG. 4.

Figure 6:
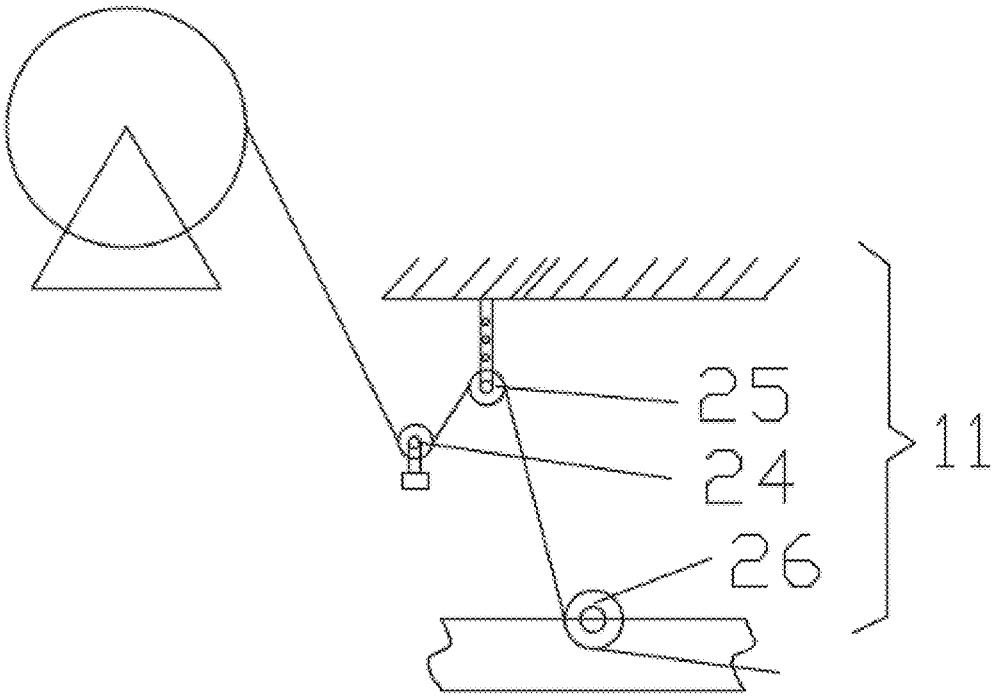
FIG. 6 is a schematic structural diagram of a tension adjuster of the present invention.

Furthermore, as shown in FIG. 6, a tension adjuster 11 is arranged at the back of the payoff stand 12, the first steel strip placement stand 17 and the second steel strip placement stand 23. The tension adjuster is formed by three rollers with different heights, including a first fixed pulley 24, an adjusting roller 25 and a second fixed pulley 26. The adjusting roller 25 is rotationally connected with a mounting frame through a locating pin. The mounting frame is equidistantly provided with multiple locating holes from top to bottom. The locating pin may be inserted into different locating holes to adjust the height of the adjusting roller 25, thereby quickly adjusting the tension of the initial cable, the steel coil raw material and the spare cable. The height adjustment of the adjusting roller 25 may be further achieved by vertically moving power tools such as a gas cylinder, an oil cylinder or an electric actuator. The gas cylinder, the oil cylinder or the electric actuator is electrically connected with a controller of the whole device to achieve automatic operation. The operation is convenient and quick and saves time and labors, and the labor strength is reduced.

The above embodiments merely describe the preferred embodiments of the present invention and are not intended to limit the scope of the present invention. Various changes and improvements made to the technical solution of the present invention by those of ordinary skill in the art without departing from the design spirit of the present invention shall fall within the protective scope of the appended claims of the present invention.

What is claimed is:

1. An electric-submersible-pump composite duct cable, comprising a steel tube shell and an isolation layer, wherein the isolation layer covers an outer circumferential surface of an ethylene-propylene jacket; the steel tube shell covers an outer circumferential surface of the isolation layer; multiple signal cable assemblies and multiple injection agent tubes are arranged inside the isolation layer; each signal cable assembly and each injection agent tube are in staggered arrangement at an internal center of the ethylene-propylene jacket; and the isolation layer is formed from a steel plate, and during a manufacture of the electric-submersible-pump composite duct cable, the isolation layer is provided with a slot which is formed below a laser welding portion of the steel tube shell through pressing the isolation layer on the ethylene-propylene jacket, and is configured for receiving an excess weld metal.

2. The electric-submersible-pump composite duct cable according to claim 1, wherein there are specifically three staggered signal cable assemblies and injection agent tubes, respectively; each signal cable assembly comprises an innermost conductor; a sintered film is arranged outside the conductor; an ethylene-propylene insulation layer is arranged outside the sintered film; a polytetrafluoroethylene F4 film is arranged outside the ethylene-propylene insulation layer; a nylon fabric layer is arranged outside the polytetrafluoroethylene F4 film; the injection agent tubes comprise one first injection agent tube and two second injection agent tubes; the diameter of the first injection agent tube is larger than the diameters of the second injection agent tubes.

3. A manufacturing method of an electric-submersible-pump composite duct cable, wherein the electric-submersible-pump composite duct cable comprises a steel tube shell and an isolation layer, wherein the isolation layer covers an outer circumferential surface of an ethylene-propylene jacket; the steel tube shell covers an outer circumferential surface of the isolation layer; multiple signal cable assemblies and multiple injection agent tubes are arranged inside the isolation layer; each signal cable assembly and each injection agent tube are in staggered arrangement at an internal center of the ethylene-propylene jacket, comprising the following steps:

step 1, manufacturing the isolation layer: an outermost layer of an electric-submersible-pump cable in initial state is the ethylene-propylene jacket, and the multiple signal cable assemblies and the multiple injection agent tubes are arranged inside the isolation layer, arranging the isolation layer on the outer circumferential surface of the ethylene-propylene jacket via a relative machining device; and step 2, machining the steel tube shell: placing a steel coil raw material for producing the steel tube shell on a first steel strip placement stand; placing a spare cable coated with the isolation layer in step 1 on a payoff stand; guiding a start end of the steel coil raw material for producing the steel tube shell to sequentially pass through a steel tube initial forming device, the payoff stand, a laser welding device, a nondestructive testing device, a drawing device and a tractor to produce a steel tube shell covering the spare cable; finally, winding a finished-product electric-submersible-pump composite duct cable composited with the steel tube shell by a second take-off stand for later use, wherein the isolation layer is formed from a steel plate, and during the manufacturing method, the isolation layer is provided with a slot which is formed below a laser welding portion of the steel tube shell through pressing the isolation layer on the ethylene-propylene jacket, and is configured for receiving an excess weld metal.

4. The manufacturing method of an electric-submersible-pump composite duct cable according to claim 3, wherein, when the isolation layer is formed from a steel plate, the steel plate is bonded on the ethylene-propylene jacket and located below a laser welding portion of the steel tube shell;

in a compositing process, the steel coil raw material for producing the steel tube shell is placed on the first steel strip placement stand; the reel of the electric-submersible-pump cable in initial state is placed on the payoff stand; the steel plate for producing the isolation layer is placed on a second steel strip placement stand; the start end of the steel coil raw material for producing the steel tube shell sequentially passes through the steel tube initial forming device, the payoff stand, the second steel strip placement stand, the laser welding device, the nondestructive testing device, the drawing device and the tractor to produce a steel tube shell covering the spare cable; finally, the finished-product electric-submersible-pump composite duct cable composited with the steel tube shell is wound by the second take-off stand for later use.

5. The manufacturing method of an electric-submersible-pump composite duct cable according to claim 3, wherein there are specifically three staggered signal cable assemblies and injection agent tubes, respectively; each signal cable assembly comprises an innermost conductor; a sintered film is arranged outside the conductor; an ethylene-propylene insulation layer is arranged outside the sintered film; a polytetrafluoroethylene F4 film is arranged outside the ethylene-propylene insulation layer; a nylon fabric layer is arranged outside the polytetrafluoroethylene F4 film; the injection agent tubes comprise one first injection agent tube and two second injection agent tubes; the diameter of the first injection agent tube is larger than the diameters of the second injection agent tubes.

* * * * *